US007629734B2

(12) United States Patent
Jeon et al.

(10) Patent No.: US 7,629,734 B2
(45) Date of Patent: Dec. 8, 2009

(54) ELECTRON EMISSION DEVICE AND DISPLAY DEVICE USING THE SAME

(75) Inventors: Sang-Ho Jeon, Yongin-si (KR); Sang-Jo Lee, Yongin-si (KR); Jin-Hui Cho, Yongin-si (KR); Sang-Hyuck Ahn, Yongin-si (KR); Su-Bong Hong, Yongin-si (KR); Byung-Gil Jea, Yongin-si (KR)

(73) Assignee: Samsung Mobile Display Co., Ltd. (KR)

( * ) Notice: Subject to any disclaimer, the term of this patent is extended or adjusted under 35 U.S.C. 154(b) by 408 days.

(21) Appl. No.: 11/586,181

(22) Filed: Oct. 25, 2006

(65) Prior Publication Data

US 2008/0018222 A1 Jan. 24, 2008

(30) Foreign Application Priority Data

Oct. 28, 2005 (KR) ..... 10-2005-0102279

(51) Int. Cl.
*H01J 63/04* (2006.01)

(52) U.S. Cl. ..... 313/495; 313/310

(58) Field of Classification Search ..... 313/495–497, 313/309–310

See application file for complete search history.

(56) References Cited

U.S. PATENT DOCUMENTS 5,734,223 A * 3/1998 Makishima et al. ..... 313/495
2005/0242707 A1* 11/2005 Hwang ..... 313/497

FOREIGN PATENT DOCUMENTS

| | | | |
|---|---|---|---|
| EP | 1542258 | A2 | 6/2005 |
| EP | 1708225 | A1 | 10/2006 |
| JP | 09-330651 | | 12/1997 |
| JP | 11-162326 | A | 6/1999 |
| KR | 10-2001-0055226 | A | 7/2001 |

OTHER PUBLICATIONS

European Search Report for Application No. 06122975.3-2208 dated May 21, 2007, 5 pgs.

* cited by examiner

*Primary Examiner*—Toan Ton
*Assistant Examiner*—Hana A Sanei
(74) *Attorney, Agent, or Firm*—Knobbe Martens Olson & Bear LLP

(57) ABSTRACT

An electron emission device is disclosed. The electron emission device includes a cathode electrode including a main electrode having an opening, ii) a plurality of isolated electrodes on each of which each of plurality of electron emission units is located, and iii) at least one resistance layer electrically connecting the main electrode and the plurality of isolated electrodes. The plurality of isolated electrodes are located within the opening and form gaps with the main electrode. A resistance between the main electrode and one of the plurality of isolated electrodes is different from that between the main electrode and the other isolated electrodes.

16 Claims, 4 Drawing Sheets

ELECTRON EMISSION DEVICE AND DISPLAY DEVICE USING THE SAME

CROSS-REFERENCE TO RELATED APPLICATION

This application claims priority to Korean patent application No. 10-2005-0102279 filed in the Korean Intellectual Property Office on Oct. 28, 2005, and all the benefits accruing therefrom under 35 U.S.C.§119, the contents of which is herein incorporated by reference in its entirety.

BACKGROUND

1. Field of the Invention

The present invention relates to an electron emission device and an electron emission display using the same.

2. Discussion of Related Technology

Generally, a hot or cold cathode can be used as an electron emission source in an electron emission device. There are several types of cold cathode electron emission devices such as a field emitter array (FEA) electron emission device, a surface conduction emission (SCE) electron emission device, a metal-insulator-metal (MIM) electron emission device, a metal-insulator-semiconductor (MIS) electron emission device, and so on.

Among these electron emission devices, the FEA electron emission device is provided with cathode and gate electrodes as driving electrodes for controlling electron emission units and emission of electrons thereof. Materials having a low work function or a high aspect ratio are used for constituting an electron emission unit in the FEA electron emission device. For example, carbon-based materials such as carbon nanotubes, graphite, and diamond-like carbon have been developed to be used in an electron emission unit in order for electrons to be easily emitted by an electrical field in a vacuum.

The plurality of electron emission units are arrayed on a substrate to form an electron emission device, and the electron emission device is combined with another substrate on which phosphors and anode electrodes are formed to produce an electron emission display.

The discussion in this section is only to provide general background information of the fuel cell technology, and does not constitute an admission of prior art.

SUMMARY OF CERTAIN INVENTIVE ASPECTS

An aspect of the invention provides an electron emission device, which may comprise: a substrate; a cathode electrode assembly formed over the substrate; and wherein the cathode electrode assembly comprises, a conductive portion; a plurality of electrodes, wherein the plurality of electrodes comprises a first electrode and a second electrode, wherein the conductive portion, the first electrode and the second electrode are spaced from one another, a connector made of a material having a specific resistance and electrically connecting the conductive portion to the plurality of electrodes, the specific resistance substantially greater than that of the first electrode; and wherein electric resistance between the conductive portion and the first electrode is different from electric resistance between the conductive portion and the second electrode.

In the foregoing device, the plurality of electrodes may comprise a third electrode, wherein the second electrode is located between the first electrode and third electrode, and wherein electric resistance between the conductive portion and the third electrode via the connector may be greater than the electric resistance between the conductive portion and the second electrode via the connector. The electric resistance between the conductive portion and the first electrode via the connector may be greater than the electric resistance between the conductive portion and the second electrode via the connector. The electric resistance between the conductive portion and the first electrode via the connector may be substantially same with the electric resistance between the conductive portion and the third electrode via the connector.

Still in the foregoing device, the shortest distance from the conductive portion to the first electrode may be greater than that from the conductive portion to the second electrode. The plurality of electrodes may comprise a third electrode, wherein the second electrode may be located between the first electrode and third electrode, and wherein the shortest distance from the conductive portion to the third electrode may be greater than that from the conductive portion to the second electrode. Each of the first and second electrodes may comprise two substantially parallel edges, and wherein the shortest distance between the two edges of first electrode may be different from that between the two edges of the second electrode. The plurality of electrodes may comprise a third electrode, wherein the second electrode may be located between the first electrode and third electrode, wherein the third electrode may comprise two substantially parallel edges, wherein the shortest distance between the two edges of the first electrode may be smaller than that between the two edges of the second electrode, and wherein the shortest distance between the two edges of the third electrode may be smaller than that between the two edges of second electrode.

Further in the foregoing method, each of the first and second electrodes may comprise a first end and second end in an imaginary axis passing the first and second electrodes, wherein the distance between the first end and second end of the first electrode may be substantially greater than from that between the first end and second end of the second electrode. Each of the first and second electrodes may comprise a first end facing the conductive portion, and wherein the connector may contact the first end of each of the first and second electrodes. The cathode electrode assembly may further comprise another connector electrically connecting the conductive portion to the plurality of electrodes, the other connector may be made of a material having a specific resistance substantially greater than that of the first electrode. Each of the first and second electrodes may comprise a first end facing the conductive portion, and wherein the connector may contact the first end of each of the first and second electrodes, and wherein each of the first and second electrodes comprises a second end, and wherein the other connector contacts the second end of each of the first and second electrodes. The conductive portion may define a hole and the first and second electrodes may be located within the hole. The cathode electrode assembly may further comprise a plurality of electron emitters, at least one of the plurality of electron emitters being formed on each of the first and second electrodes.

Another aspect of the invention provides a display device which may comprise the foregoing electron emission device.

Still another aspect of the invention provides a method of making an electron emission device, which may comprise: providing a substrate; forming a cathode electrode assembly over the substrate; and wherein the cathode electrode assembly comprises a conductive portion, a plurality of electrodes comprising a first electrode and a second electrode, wherein the conductive portion, the first electrode and the second electrode are spaced from one another, a connector made of a material having a specific resistance and electrically connecting the conductive portion to the plurality of electrodes, the specific resistance substantially greater than that of the first electrode, wherein electric resistance between the conductive portion and the first electrode is different from electric resistance between the conductive portion and the second electrode.

In the foregoing method, the plurality of electrodes may comprise a third electrode, wherein the second electrode is located between the first electrode and third electrode, wherein electric resistance between the conductive portion and the third electrode via the connector may be greater than the electric resistance between the conductive portion and the second electrode via the connector. The electric resistance between the conductive portion and the first electrode via the connector may be greater than the electric resistance between the conductive portion and the second electrode via the connector. The shortest distance from the conductive portion to the first electrode may be greater than the shortest distance from the conductive portion to the second electrode. The cathode electrode assembly may further comprise a plurality of electron emitters, at least one of the plurality of electron emitters being formed on each of the first and second electrodes.

One aspect of the present invention may provide an electron emission device including i) a substrate, ii) a cathode electrode located on the substrate, iii) a gate electrode electrically insulated from the cathode electrode, and iv) a plurality of electron emission units adapted to electrically connect to the cathode electrode. The cathode electrode includes i) a main electrode having an opening, ii) a plurality of isolated electrodes on each of which each of the plurality of electron emission units is located, and iii) at least one resistance layer electrically connecting the main electrode and the plurality of isolated electrodes. The plurality of isolated electrodes are located within the opening and form gaps with the main electrode. A resistance between the main electrode and one of the plurality of isolated electrodes is different from a resistance between the main electrode and the other isolated electrodes.

According to another aspect of the present invention, the one isolated electrode may be located to be close to or at a center of the opening and the other isolated electrodes may be located near an edge of the opening. The resistance between the main electrode and the one isolated electrode may be lower than the resistance between the main electrode and the other isolated electrodes. The resistance between the main electrode and each of the plurality of isolated electrodes may decrease as each of the isolated electrodes is located closer to or at a center of the opening.

According to another aspect of the present invention, the one isolated electrode may be different from the other isolated electrodes in the length of the gap. The one isolated electrode may be located to be close to or at a center of the opening and the other isolated electrodes may be located near an edge of the opening. The gap between the main electrode and the other isolated electrodes may be greater than the length of the gap between the main electrode and the one isolated electrode. The gap between the main electrode and each of the plurality of isolated electrodes may decrease as each of the isolated electrodes is located closer to or at a center of the opening.

According to another aspect of the present invention, each of the plurality of isolated electrodes may include an edge extending in a direction to cross a longitudinal direction of the cathode electrode. The one isolated electrode may be different from the other isolated electrodes in the length of the edge. The one isolated electrode may be located to be close to or at a center of the opening and the other isolated electrodes may be located near an edge of the opening. The edge of the one isolated electrode may be longer than the edge of the other isolated electrodes. The lengths of the edges of the plurality of isolated electrodes may increase as each of the isolated electrodes is located closer to or at a center of the opening. The opening may include a pair of edges facing each other in a parallel manner. The at least one resistance layer may include a resistance layer including a pair of edges facing each other in a parallel manner.

According to another aspect of the present invention, the plurality of isolated electrodes may be arranged in a longitudinal direction of the cathode electrode. The at least one resistance layer may include a pair of resistance layers. Each of the resistance layers may electrically connect a pair of edges of the isolated electrodes, respectively, which face each other and extend in the longitudinal direction of the cathode electrode.

Another aspect of the present invention may provide an electron emission device further including a focusing electrode insulated from the gate electrode and located on the gate electrode. The focusing electrode may have another opening for passing electrons emitted from the plurality of electron emission units therethrough.

Another aspect of the present invention may provide an electron emission display including i) opposing first and second substrates, ii) a cathode electrode located on the first substrate, iii) a gate electrode electrically insulated from the cathode electrode, iv) a plurality of electron emission units adapted to electrically connect to the cathode electrode, v) a phosphor layer located on the second substrate, and vi) an anode electrode located on the second substrate. The cathode electrode includes i) a main electrode having an opening, ii) a plurality of isolated electrodes on each of which each of the plurality of electron emission units is located, and iii) at least one resistance layer electrically connecting the main electrode and the plurality of isolated electrodes. The plurality of isolated electrodes are located within the opening and form gaps with the main electrode. A resistance between the main electrode and one of the plurality of isolated electrodes may be different from a resistance between the main electrode and the other isolated electrodes.

According to another aspect of the present invention, the one isolated electrode may be different from the other isolated electrodes in the length of the gap. Each of the isolated electrodes may include an edge extending in a direction to cross the cathode electrode. The one isolated electrode may be different from the other isolated electrodes in the length of the edge.

DETAILED DESCRIPTION OF EMBODIMENTS

Figure 1:
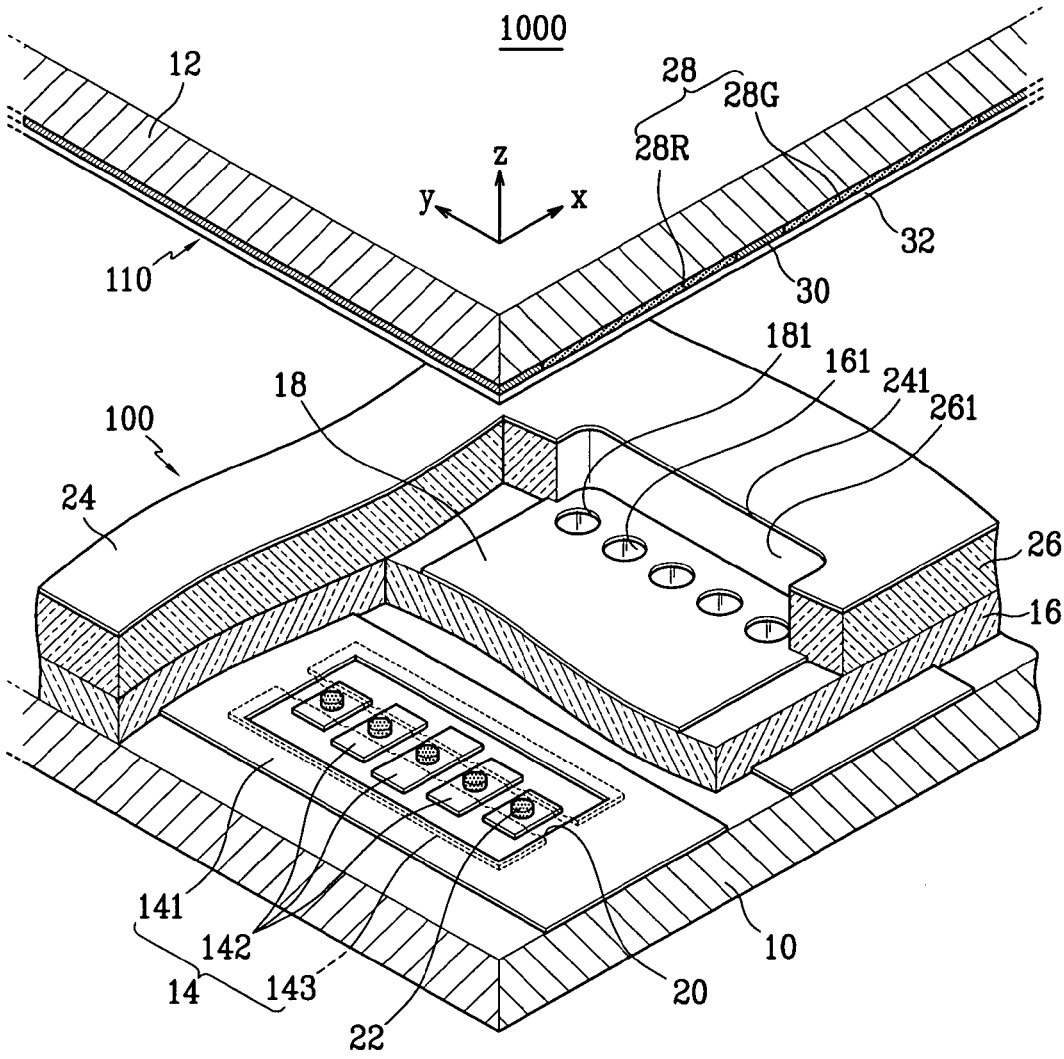
FIG. 1 is a partial exploded perspective view of the electron emission display in accordance with an embodiment.

With reference to the accompanying drawings, various embodiments of the present invention will be described in order for those skilled in the art to be able to implement it. As those skilled in the art would realize, the described embodiments may be modified in various different ways, all without departing from the spirit or scope of the present invention. Wherever possible, the same reference numbers will be used throughout the drawings to refer to the same or like parts.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms first, second, third, etc., may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the invention. As used herein, the singular forms "a," "an", and "the" are intended to include the plural forms as well, unless the context clearly indicates otherwise. It will be further understood that the terms "comprises", and/or "comprising," or "includes", and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper", "over", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross-sectional illustrations that are schematic illustrations of embodiments of the present invention. As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

FIG. 1 illustrates a partial exploded perspective view of an electron emission display 1000 in accordance with an embodiment. As illustrated in FIG. 1, the electron emission display 1000 includes first and second substrates 10 and 12 facing each other. The first and second substrates 10 and 12 are located to be parallel to each other with a predetermined distance therebetween. A sealing member (not shown) is disposed on edges of the first and second substrates 10 and 12 such that they are attached to each other. The internal space formed by the two substrates 10 and 12 and the sealing member is evacuated to approximately $10^{-6}$ torr to form a vacuum vessel. Electron emission units or electron emitters 22 are arranged in an array on the first substrate 10 facing the second substrate 12, and they constitute an electron emission device 100 with the first substrate 10. The electron emission device 100 is assembled with the second substrate 12 on which a light emitting unit 110 is provided, thereby constituting the electron emission display 1000.

Cathode electrodes 14 are formed in a stripe pattern on the first substrate 10, and a first insulating layer 16 is located on the entire surface of the first substrate 10 while covering the cathode electrodes 14. Gate electrodes 18 are located on the first insulating layer 16, electrically insulated from the cathode electrodes 14, in a stripe pattern in a direction to cross the cathode electrodes 14. In one embodiment, a unit pixel area may be defined as a crossing area of one cathode electrode 14 and one gate electrode 18. Each cathode electrode 14 includes a main electrode or conductive portion 141, a plurality of isolate electrodes 142, and resistance layers 143 in the unit pixel area. The resistance layers 143 are illustrated by using dotted lines in FIG. 1 for convenience.

An opening or hole 20 is formed in the main electrode 141, and includes a pair of edges extending in a y-axis direction. The pair of edges face each other in a parallel manner. The plurality of isolate electrodes 142 are located within the opening 20 and are separated from the main electrodes 141. The main electrode 141 is adapted to electrically connect the plurality of isolate electrodes 142 through the resistance layers 143 at left and right sides of the isolate electrodes 142. One end of the main electrode 141 is configured to electrically connect an external circuit (not shown) and a driving voltage is applied to the main electrode 141 through the external circuit.

The resistance layers 143 partially cover the opening 20, and also partially cover the main electrode 141 and the isolate electrodes 142. As a result, a contacting resistance between the main electrode 141 and the isolate electrodes 142 is reduced. The resistance layers 143 include a pair of edges extending in the y-axis direction. The pair of edges face each other in a parallel manner. The resistance layers 143 are made of a material with a specific resistance in the range from approximately 10,000 Ωcm to 100,000 Ωcm. The specific resistance of the material is greater than that of a general conductive material contained in the main electrode 141 and the isolate electrodes 142. The material may include, for example, p-type doped amorphous silicon. In one embodiment, even if an unstable driving voltage is applied to the main electrode 141 or if the voltage is suddenly dropped in the main electrode 141, a stable driving voltage can be continuously applied to the electron emission units 22 due to the resistance layers 143. Therefore, electron emission properties of the electron emission units 22 can be uniformly maintained.

The electron emission units 22 are located on the isolate electrodes 142. The electron emission units 22 contain materials that are capable of emitting electrons, such as carbon-based or nanometer-sized materials, when an electric field is formed. The electron emitting units 22 may contain, for example, carbon nanotubes, graphite, graphite nanofibers, diamond, diamond-like carbon, $C_{60}$, silicon nanowire, and combinations thereof. The electron emission units 22 may have a sharp tip and be mainly made of, for example, molybdenum, silicon, and so on. Openings 161 and 181 are formed in the first insulating layer 16 and the gate electrodes 18, respectively, in order for the electron emission units 22 to maintain a space for emitting electrons. A focusing electrode 24 is located on a second insulating layer 26. Therefore, the gate electrodes 18 are electrically insulated from the focusing electrode 24. Openings 261 and 241 are provided in the second insulating layer 26 and the focusing electrode 24, respectively, such that electron beams emitted from the electron emission units 22 pass through the openings 261 and 241. One set of the openings 261 and 241 may be formed on one unit pixel area. As a result, electrons emitted from a pixel area are well focused.

Figure 2:
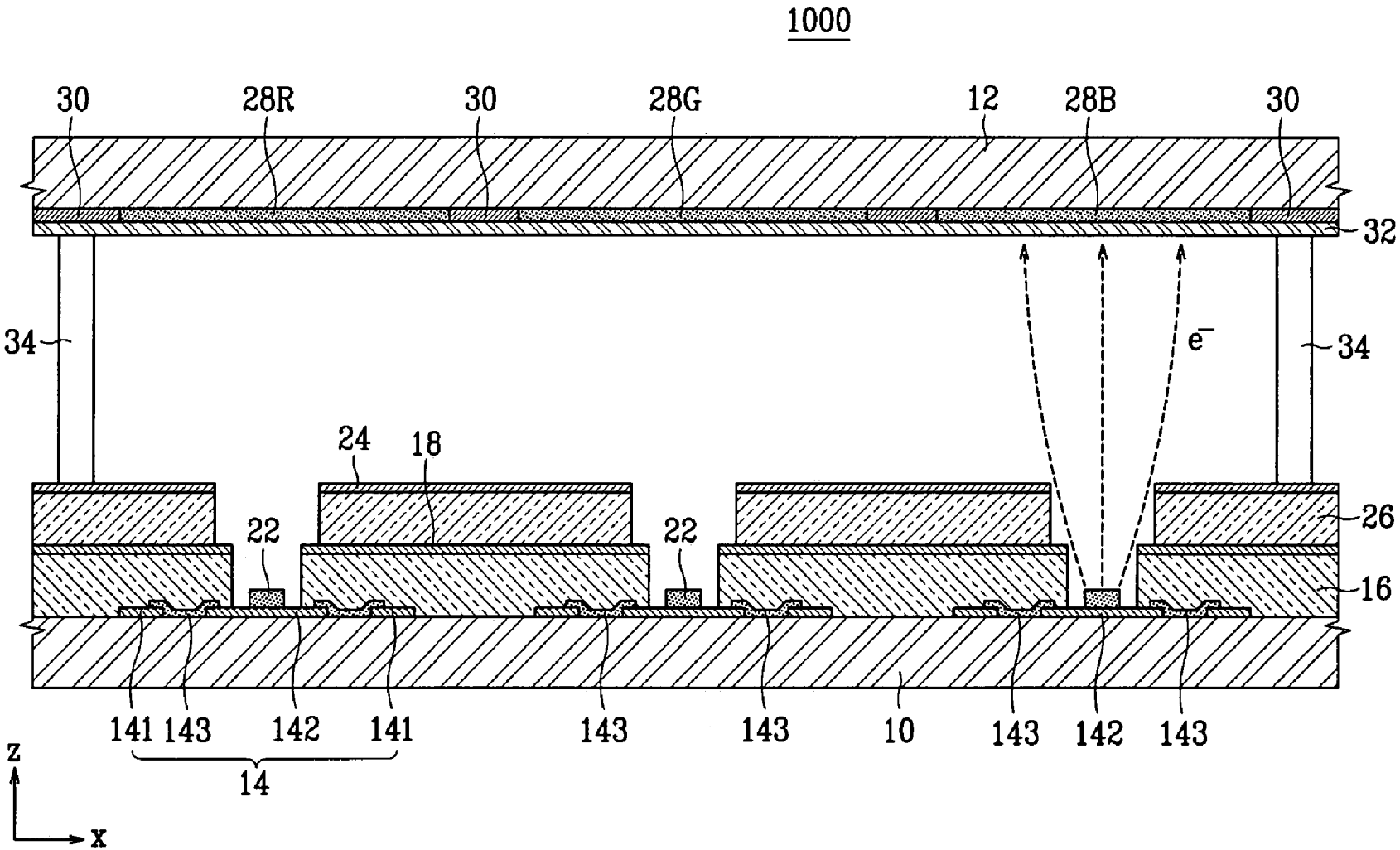
FIG. 2 is a partial cross-sectional view of the electron emission display in accordance with an embodiment.

In one embodiment, phosphor layers 28, for example, red, green, and blue phosphor layers 28R, 28G, and 28B (phosphor layer 28B is shown in FIG. 2) are formed to be spaced apart from each other on a surface of the second substrate 12 facing the first substrate 10. Black layers 30 are formed between each of the phosphor layers 28 in order to absorb ambient light. Each phosphor layer 28 corresponds to a unit pixel area.

In addition, anode electrodes 32 made of a metallic film such as aluminum are formed on the phosphor layers 28 and the black layers 30. External high voltages, which are sufficient to accelerate electron beams, are applied to the anode electrodes 32 and are then maintained at high electric potentials by the anode electrodes 32. Among the visible rays emitted from the phosphor layers 28, visible rays directed to the first substrate 10 are reflected back toward the second substrate 12 by the anode electrodes 32, and thereby brightness is enhanced. In another embodiment, the anode electrodes 32 can be made of a transparent conductive film such as indium tin oxide (ITO), for example. In this case, the anode electrode may be located between the second substrate and the phosphor layers. In addition, the transparent conductive films and metallic films can be formed together as an anode electrode.

FIG. 2 illustrates a partial cross-sectional view of the electron emission display 1000 in accordance with an embodiment. Spacers 34 are located between the two substrates 10 and 12, thereby supporting the substrates 10 and 12 against a compressing force applied to a vacuum space therebetween. The spacers 34 uniformly maintain a gap between the two substrates 10 and 12, and they are located directly beneath the black layers 30 in order for them to be invisible from the outside.

In one embodiment, the electron emission display 1000 is driven by external voltages to be applied to the cathode electrodes 14, the gate electrodes 18, the focusing electrode 24, and the anode electrodes 32. Scan driving voltages are applied to one of the cathode electrodes 14 and the gate electrodes 18, and thus the one electrodes function as scanning electrodes. In addition, data driving voltages are applied to the other electrodes, and thus the other electrodes function as data electrodes. Voltages necessary to focus the electron beams, such as 0V or negative direct current voltages of several to several tens of volts, are applied to the focusing electrode 24, while positive direct current voltages of several hundreds to several thousands of volts are applied to the anode electrodes 32 for accelerating the electron beams.

Then, electric fields are formed around the electron emission units 22 at the pixels where the voltage difference between the cathode electrodes 14 and the gate electrodes 18 exceeds a threshold value, and thereby electrons emit therefrom. The emitted electrons are focused on a center portion of the electron beams while passing through the openings 241 of the focusing electrode 24. They are also attracted by the high voltage applied to the anode electrodes 32 and collide against the corresponding phosphor layers, for example 28R, 28G, and 28B. Thus, light is emitted from the electron emission display 1000 and an image is displayed.

Figure 3:
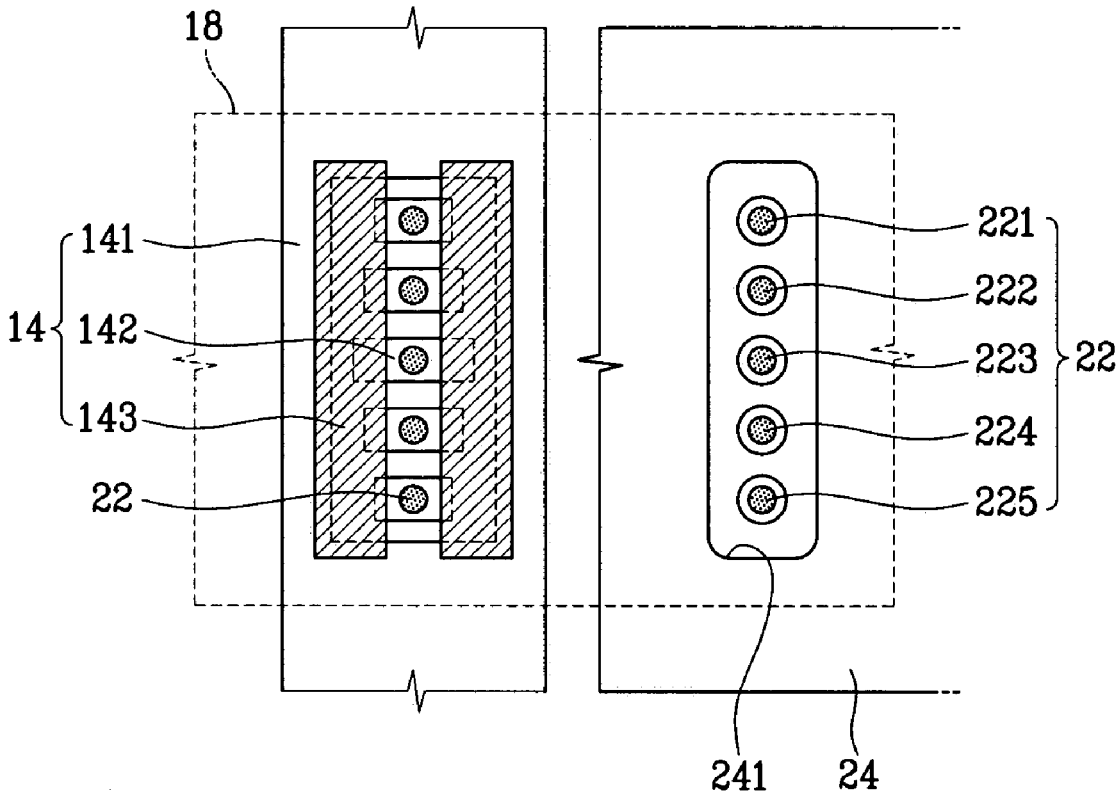
FIG. 3 is a partial exploded plan view of the electron emission display of FIG. 1.

FIG. 3 illustrates a partial plan view of the electron emission display 1000 device of FIG. 1. As illustrated in FIG. 3, a left part is not covered with the focusing electrode 24 while a right part is covered with the focusing electrode 24. Therefore, the cathode electrodes 14 and the electron emission units 22 are shown exposed in the left part. The gate electrode 18 is indicated by dotted lines in FIG. 3 for convenience. As illustrated in FIG. 3, five electron emission units 22 are arranged in a row in a unit pixel area, and are exposed through the opening 241 of the focusing electrode 24. The five electron emission units 22 include first to fifth electron emission units 221, 222, 223, 224, and 225.

Among the five electron emission units 22, the first and fifth electron emission units 221 and 225 are located near edges of the opening 241, and so sides thereof are very close to the focusing electrode 24. Therefore, the first and fifth electron emission units 221 and 225 are largely influenced by a focusing electric field generated by the focusing electrode 24. Contrarily, since the third electron emission unit 223 is located at the center of the opening 241, it is relatively little influenced by the focusing electric field. Although not illustrated in FIG. 3, the third electron emission unit 223 may be located to be close to the center of the opening 241.

Therefore, after predetermined driving voltages are applied to the cathode electrode 14, the gate electrode 18, and the focusing electrode 24, the electric field for emitting electrons is generated and the electron emission units 22 starts to emit electrons. However, since the electric field for emitting electrons is weakened by the focusing electric field in the first and fifth electron emission units 221 and 225, an amount of current for emitting electrons thereof is also reduced. Therefore, the first and fifth electron emission units 221 and 225 have a different amount of current for emitting electrons from that of the third electron emission unit 223.

In this case, the resistance layer 143 compensates a voltage difference corresponding to the above current difference in order to equalize the amount of electrons emitted from the electron emission units 22. In one embodiment, a voltage of the third electron emission unit 223 is hardly dropped even in the above situation.

In a typical electron emission device, an amount of current for emitting electrons in each electron emission unit can be different from each other by an external factor. Since the external factor can differently influence on each electron emission unit, an amount of electrons emitted from the electron emission units may be different from each other and total currents for emitting electrons from the electron emission units are reduced. As a result, brightness of the display device is deteriorated and thus it is necessary to raise the driving voltage and compensate for the deficient current.

In comparison with the typical electron emission device, in one embodiment, a resistance between the main electrode 141 and the isolate electrodes 142 is controlled in order to prevent the voltage from greatly dropping. That is, a resistance between the main electrode 141 and the isolate electrodes 142 is controlled depending on a location of the isolate electrodes 142.

Figure 4:
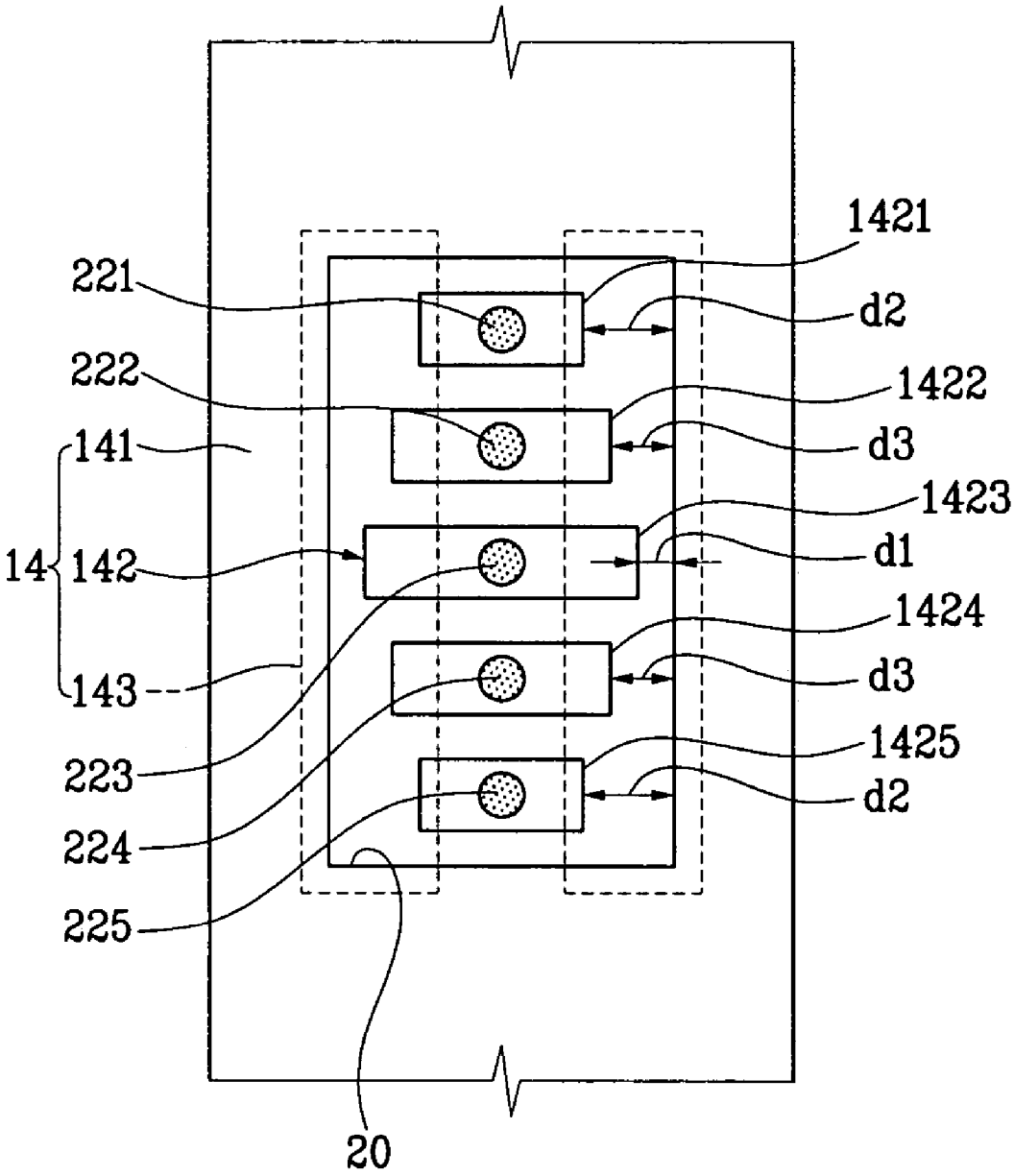
FIG. 4 is an enlarged plan view of the cathode electrodes of FIG. 3.

In one embodiment, for example, the resistance between the main electrode 141 and one isolate electrode 142 may be different from that between the main electrode 141 and the other isolate electrodes 142. The resistance between the main electrode 141 and the isolate electrodes 142 will be explained in detail with reference to FIG. 4. FIG. 4 illustrates a magnified cathode electrode 14 of FIG. 3. The resistance layers 143 are indicated by dotted lines in FIG. 4 for convenience. The electron emission units 221, 222, 223, 224, and 225 are located on isolate electrodes 1421, 1422, 1423, 1424, and 1425, respectively.

The plurality of isolate electrodes 1421 to 1425 are arranged in a y-axis direction. The plurality of isolate electrodes 1421 to 1425 include a pair of edges extending in a y-axis direction. The pair of edges face each other. Two resistance layers 143 electrically connect to the pair of edges, respectively. In one embodiment, a resistance between the main electrode 141 and each isolate electrode 142 is different from each other. For example, in one embodiment, a resistance between the main electrode 141 and the first isolate electrode 1421 is lower than that between the main electrode 141 and the third isolate electrode 1423. This is the same for the fifth isolate electrode 1425 and the third isolate electrode 1423.

On the other hand, the resistance between the main electrode 141 and each of the isolate electrodes 142 may decrease as each of the isolate electrodes 142 is located to be closer to or at a center of the opening 20. Then, a resistance between the main electrode 141 and the third isolate electrode 1423 is reduced, and a voltage, whose loss is reduced, is more efficiently applied to the third isolate electrode 1423. Accordingly, a voltage of the third electron emission unit 223 is prevented from being dropped. As a result, a brightness of the electron emission display is enhanced due to an increase of an amount of current for emitting electrons from an electron emission unit and the electron emission display is favorable to be driven by using a low voltage.

In one embodiment, a resistance may be differentiated by the length of the gap between the main electrode 141 and the isolate electrodes 142 as illustrated in FIG. 4. The length of the gap between the main electrode 141 and the isolate electrodes 142 is different from each other depending on a location of the isolate electrodes 142. Since the resistance layers 143 are formed to have a uniform width between the main electrode 141 and the isolate electrodes 142, the resistance layers 143 hardly influence on the resistance between the main electrode 141 and the isolate electrodes 142. Instead, the resistance between the main electrode 141 and the isolate electrodes 142 depends on the length of the gap.

In one embodiment, as the length of the gap increases, the resistance increases. The length of the gap decreases as the isolate electrodes 142 are located closer to or at a center of the opening 20, for example, as illustrated in FIG. 4, the length of the gap d2 is greater than that of the gap d3. Therefore, the resistance between the main electrode 141 and the first and fifth isolate electrodes 1421 and 1425 is greater than that between the main electrode 141 and the second and fourth isolate electrodes 1422 and 1424. In addition, the length of the gap d3 is greater than that of the gap d1. Therefore, the resistance between the main electrode 141 and the second and fourth isolate electrodes 1422 or 1424 is greater than that between the main electrode 141 and the third electrode 1423.

From a different point of view, the resistance between the main electrode 141 and the isolate electrodes 142 may be differentiated depending on the width of the isolate electrodes 142. In FIG. 4, the width is defined as the length of the edge of the isolate electrodes 142 extending in an x-axis direction. The edge extends in a direction to cross a longitudinal direction (y-axis direction) of the cathode electrode 14. The first, second, and third isolate electrodes 1421, 1422, and 1423 are different from each other in their width.

As illustrated in FIG. 4, the width of the third isolate electrode 1423 is greater than that of the second and fourth isolate electrodes 1422 and 1424. In addition, the widths of the second and fourth electrodes 1422 and 1424 are greater than those of the first and fifth isolate electrodes 1421 and 1425. As the isolate electrodes 142 are located closer to or at the center of the opening 20, the width of the isolate electrodes 142 increases.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations falling within the meaning and range of equivalency of the claims are embraced within their scope.

What is claimed is:

1. An electron emission device, comprising:

a substrate; and a cathode electrode assembly formed over the substrate;

wherein the cathode electrode assembly comprises:

a first electrode;

a second set of electrodes, wherein each of the second set of electrodes is spaced from the first electrode; and a resistance layer made of a material having a specific resistance and electrically connecting the first electrode and the second set of electrodes;

wherein the second set of electrodes have a variation in electric resistance with the first electrode based at least on their respective spacing from the first electrode.

2. The device of claim 1, wherein the second set of electrodes comprise a second and a third electrodes, and the electric resistance between the first electrode and the third electrode is greater than the electric resistance between the first electrode and the second electrode.

3. The device of claim 2, wherein the second set of electrodes further comprises a fourth electrode and the electric resistance between the first electrode and the second electrode is substantially same with the electric resistance between the first electrode and the fourth electrode.

4. The device of claim 2, wherein the shortest distance from the first electrode to the third electrode is greater than that from the first electrode to the second electrode.

5. The device of claim 2, wherein each of the second and third electrodes comprises two substantially parallel edges, wherein the shortest distance between the two edges of second electrode is different from that between the two edges of the third electrode.

6. The device of claim 5, wherein the shortest distance between the two edges of the third electrode is smaller than that between the two edges of the second electrode.

7. The device of claim 2, wherein each of the second and third electrodes comprises a first end facing the first electrode, and wherein the resistance layer contacts the first end of each of the second and third electrodes.

8. The device of claim 2, wherein the cathode electrode assembly further comprises another resistance layer electrically connecting the first electrode to the second set of electrodes, the other resistance layer being made of a material having a specific resistance substantially greater than that of the second electrode.

9. The device of claim 8, wherein each of the second and third electrodes comprises a first end facing the first electrode, and wherein the resistance layer contacts the first end of each of the second and third electrodes, and wherein each of the second and third electrodes comprises a second end, and wherein the other resistance layer contacts the second end of each of the second and third electrodes.

10. The device of claim 2, wherein the first electrode defines a hole and the second and third electrodes are located within the hole.

11. The device of claim 2, wherein the cathode electrode assembly further comprises a plurality of electron emitters, at least one of the plurality of electron emitters being formed on each of the second and third electrodes.

12. A display device comprising the electron emission device of claim 1.

13. A method of making an electron emission device, the method comprising:

providing a substrate;

forming a cathode electrode assembly over the substrate; and wherein the cathode electrode assembly comprises:

a first electrode;

a second set of electrodes wherein each of the second set of electrodes is spaced from the first electrode; and a resistance layer made of a material having a specific resistance and electrically connecting the first electrode and the second set of electrodes;

wherein the second set of electrodes have a variation in electric resistance with the first electrode based at least on their respective spacing from the first electrode.

14. The method of claim 13, wherein the second set of electrodes comprise a second and third electrodes, wherein the electric resistance between the first electrode and the third electrode is greater than the electric resistance between the first electrode and the second electrode.

15. The method of claim 14, wherein the shortest distance from the first electrode to the third electrode is greater than the shortest distance from the first electrode to the second electrode.

16. The method of claim 14, wherein the cathode electrode assembly further comprises a plurality of electron emitters, at least one of the plurality of electron emitters being formed on each of the second and third electrodes.

* * * * *

UNITED STATES PATENT AND TRADEMARK OFFICE

CERTIFICATE OF CORRECTION

PATENT NO. : 7,629,734 B2
APPLICATION NO. : 11/586181
DATED : December 8, 2009
INVENTOR(S) : Sang-Ho Jeon et al.

It is certified that error appears in the above-identified patent and that said Letters Patent is hereby corrected as shown below:

Title page, item [57]: please delete "opening, ii)", and insert --opening,--, therefore.

Title page, item [57]: please delete "and iii)", and insert --and--, therefore.

Signed and Sealed this
Seventh Day of June, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,629,734 B2
APPLICATION NO. : 11/586181
DATED : December 8, 2009
INVENTOR(S) : Sang-Ho Jeon et al.

It is certified that error appears in the above-identified patent and that said Letters Patent is hereby corrected as shown below:

On the title page, item [73]: please change "Samsung Mobile Display Co." to --Samsung SDI Co., Ltd--

Signed and Sealed this
Twenty-seventh Day of September, 2011

David J. Kappos

David J. Kappos
*Director of the United States Patent and Trademark Office*